US005310527A

United States Patent [19]

Romanauskas et al.

[11] Patent Number: 5,310,527

[45] Date of Patent: May 10, 1994

[54] TUBE FOR USE IN A PELLETING CENTRIFUGE ROTOR

[75] Inventors: William A. Romanauskas; Hugh H. Tansey, III, both of Southbury, Conn.

[73] Assignee: E. I. Du Pont de Nemours and Company, Wilmington, Del.

[21] Appl. No.: 990,103

[22] Filed: Dec. 14, 1992

[51] Int. Cl.[5] ..... B01L 3/14

[52] U.S. Cl. ..... 422/102; 422/58; 422/99; 422/100; 494/16; 494/17; 494/20; 494/37

[58] Field of Search ..... 422/100, 102, 58, 99; 494/17, 16, 20, 37

[56] References Cited

U.S. PATENT DOCUMENTS

| | | | |
|---|---|---|---|
| 2,878,994 | 3/1959 | Anderson | 233/26 |
| 3,720,502 | 3/1973 | Gropper et al. | 422/102 X |
| 3,788,815 | 1/1974 | Rohrbaugh | 422/102 X |
| 3,814,522 | 6/1974 | Clark et al. | 356/246 |
| 3,849,256 | 11/1974 | Linder | 422/102 X |
| 4,021,124 | 5/1977 | Sarstedt | 356/246 |
| 4,074,976 | 2/1978 | Gower et al. | 422/102 X |
| 4,278,437 | 7/1981 | Haggar | 23/230 |
| 4,290,997 | 9/1981 | Suovaniemi | 422/102 X |
| 4,301,963 | 11/1981 | Nielsen | 422/102 X |
| 4,628,036 | 12/1986 | Scheepens et al. | 436/520 |
| 4,659,550 | 4/1987 | Schildknecht | 422/73 |
| 4,804,355 | 2/1989 | Brimhall et al. | 494/20 |
| 4,865,812 | 9/1989 | Kuntz et al. | 422/99 |
| 4,878,597 | 11/1989 | Haast | 220/404 |
| 4,927,605 | 5/1990 | Dorn et al. | 422/102 |
| 5,030,421 | 7/1991 | Muller | 422/102 |
| 5,047,004 | 9/1991 | Wells | 494/17 |
| 5,132,232 | 7/1992 | Parker | 436/177 |

*Primary Examiner*—James C. Housel
*Assistant Examiner*—Harold Y. Pyon

[57] ABSTRACT

A tube for use in a pelleting centrifuge rotor is characterized in first aspect by a first, acute, corner and a second, obtuse, corner defined in the lowermost pelleting region thereof. The corner defined by the acute angle lies a greater axial distance from the mouth of the tube than the corner defined by the obtuse angle. In a second aspect the tube the interior of the tube has a constricted region with a guide adjacent thereto. The guide channel is sized to accept a supernatant removal implement.

8 Claims, 3 Drawing Sheets

TUBE FOR USE IN A PELLETING CENTRIFUGE ROTOR

BACKGROUND OF THE INVENTION 1. Field of the Invention

The present invention relates to a tube for use in a pelleting centrifuge rotor. 2. Description of the Prior Art A centrifugal pelleting operation is the usual procedure used to separate solid particles, such as cells, suspended in a liquid supernatant. In a pelleting operation a container, typically a test tube, having the liquid suspension therein is placed in a cavity of a centrifuge rotor and subjected to a centrifugal force field. Centrifugal force causes the solid material to separate from the liquid supernatant and to deposit itself in a clump, called a pellet, on the wall of the tube. When the liquid supernatant is withdrawn from the tube the pellet may be removed for analysis or resuspended for further processing.

The tubes that are commonly used in pelleting applications within a pelleting rotor are circular at every cross section taken perpendicular to the tube axis along the tube's entire axial length. This standard test tube shape imparts a conical end to the tube that makes difficult both the location of the pellet on the bottom of the tube bottom as well as the removal of the all of supernatant from the tube.

The problem of pellet location is made somewhat easier when a capped microtube is used as the container, inasmuch as the tab on the cap provides a convenient feature that can be used to orient the microtube within the rotor cavity.

In another aspect, it is sometimes the case that the volume of the liquid suspension available for processing is limited. In these instances, rather than diluting the available volume of the suspension, it may be necessary or desirable to use a separate adapter within the tube in order to have the suspension fill more completely the interior volume of the tube.

In view of the foregoing it is believed advantageous to provide a tube having a shape that facilitates both the location of the pellet within the tube and the removal of supernatant from the tube. It is also believed advantageous to provide a tube that has a constricted interior volume thereby to present a volume that is sized more closely to the available volume of the suspension.

SUMMARY OF THE INVENTION

The present invention relates to a tube for use in a pelleting centrifuge rotor to separate solid particles from the liquid supernatant in which they are suspended. The tube has a body with an open upper end, or mouth, and a closed lower end. The body has an axis extending therethrough. The interior volume of the tube is subdivided into an upper volume portion and a lower pelleting volume portion. The lower pelleting volume portion is defined by at least two interior surfaces that cooperate to form a first and a second corner therein.

In accordance with a first aspect of the invention the first corner subtends an acute angle and the second corner subtends an obtuse angle, with the corner subtending the acute angle lying a greater axial distance from the mouth of the tube than the corner subtending the obtuse angle. The tube may carry an indicia thereon for orienting the tube within a recess of a pelleting centrifuge rotor so that, in use in a pelleting centrifuge rotor rotating about an axis of rotation, the obtuse corner is disposed at the greatest distance from the axis of rotation so that a pellet is formed within this corner.

In accordance with a second aspect of the invention the interior volume of the tube has a generally keyhole-shaped configuration when viewed in a plane perpendicular to the axis of the tube. The keyhole-shaped configuration is defined by a generally diametrically extending slot-like constricted region and a relatively enlarged guide channel adjacent thereto. When used in a tube having first and second corners subtending respective acute and obtuse angles, the guide channel is arranged such that an axis extending therethrough projects into the corner subtending the acute angle. Preferably, only the cross section of the guide channel is sized to accept a supernatant removal implement.

BRIEF DESCRIPTION OF THE DRAWINGS

The invention will be more fully understood from the following detailed description, taken in accordance with the accompanying drawings, which form a part of this application and in which:

FIGS. 9 and 10 are, respectively, perspective and plan views of a tube in accordance with a second aspect of the present invention, while

DETAILED DESCRIPTION OF THE INVENTION

Figure 1:
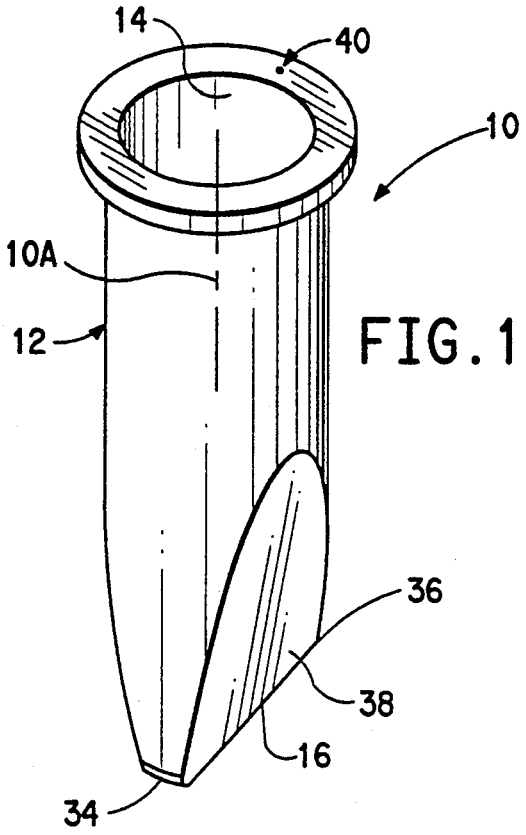
FIG. 1 is a perspective view of a tube in accordance with one aspect of the present invention.

Throughout the following detailed description similar reference numerals refer to similar elements in all Figures of the drawings.

FIGS. 1 through 6 illustrate a tube 10 in accordance with a first aspect of the present invention useful in a pelleting centrifuge rotor R (FIG. 7) to separate solid particles from the supernatant in which they are suspended. As seen in FIG. 7, the rotor R has a plurality of cavitites C arranged about an axis of rotation CL. Each cavity C is inclined at a predetermined angle Θ with respect to the axis of rotation CL.

The tube 10 includes a body 12 having an open mouth 14 and a closed lower end 16. The tube has an axis 10A extending therethrough. The interior of the body 12 of the tube 10 is subdivided into an upper volume portion 18 and a lower pelleting volume region 20. The tube may be capped, if desired.

Figure 2:
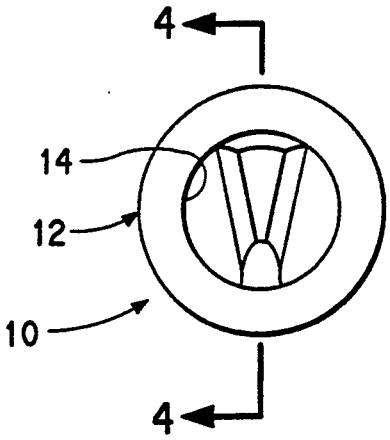
FIGS. 2 and 3 are, respectively, plan and side elevational views of the tube of FIG. 1, with a part of FIG. 3 being broken away and being shown in section.
Figure 3:
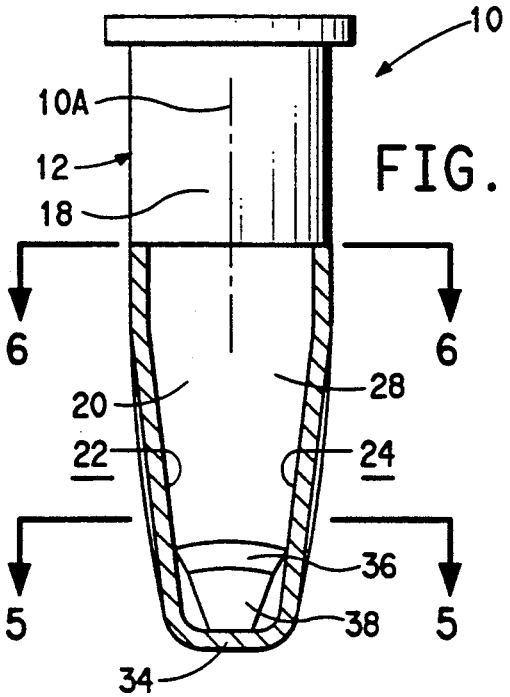
Figure 4:
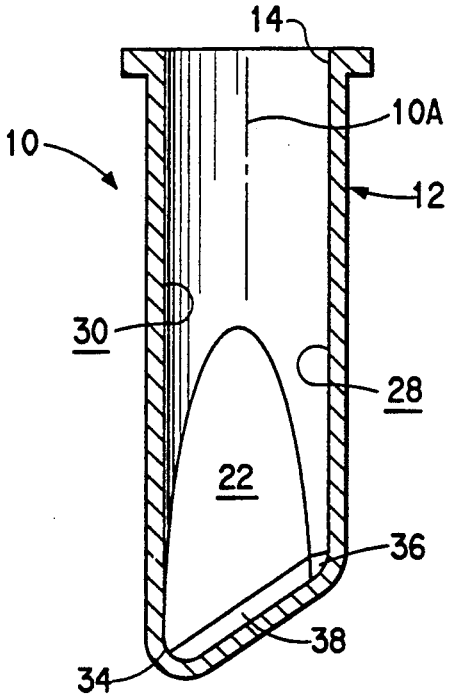
FIGS. 4 through 6 are sectional views taken along the respective section lines shown in FIGS. 2 and 3.
Figure 5:
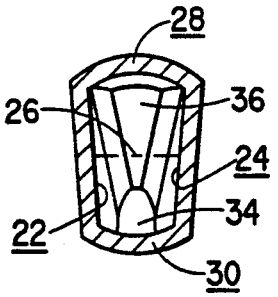
Figure 6:
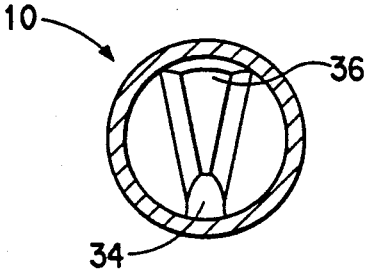
Figure 7:
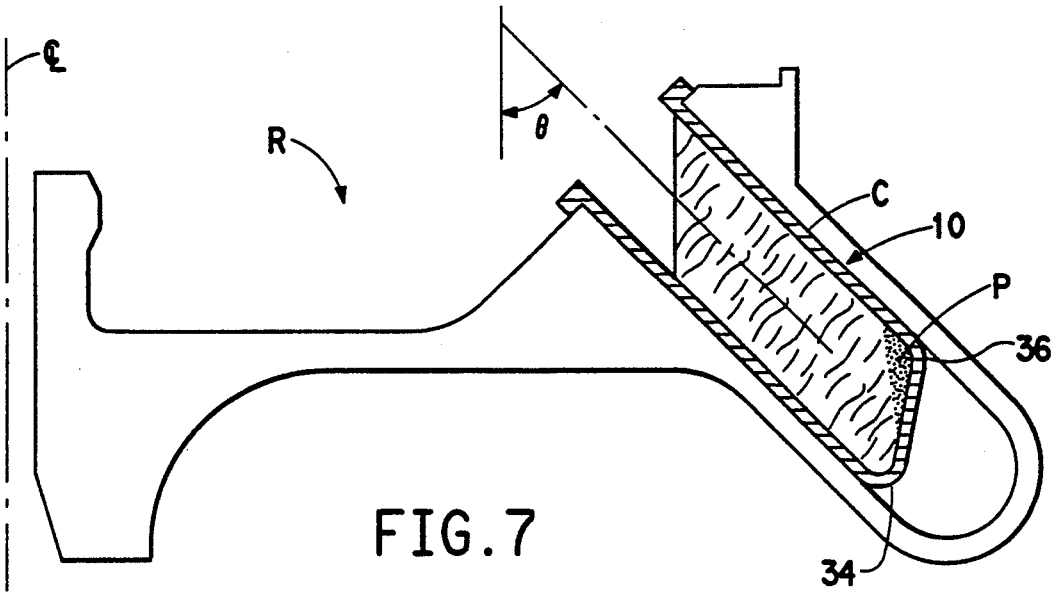

The upper volume portion 18 of the tube 10 has a generally circular configuration when taken in cross section, that is, in a plane perpendicular to the axis 10A (the plane of FIGS. 2, 5 and 6). The interior of the lower pelleting volume portion 20 of the tube 10 is defined by at least a first surface 22 and a second surface 24. Preferably the surfaces 22, 24 are each generally planar. In the Figures (as particularly seen in FIG. 5) the surfaces 22, 24 are oriented with respect to each other so that they are inclined with respect to a transverse reference plane 26. It should be understood that the planar surfaces 22, 24 may, if desired, be arranged with respect to each other such that the transverse reference plane 26 lies perpendicular to each planar surface 22, 24. Moreover, in practice, the lower pelleting volume portion 20 also includes cylindrical surface segments 28, 30 that connect the adjacent lateral ends of the planar surfaces 22, 24. It lies within the contemplation of this invention to configure the surfaces 22, 24 as nonplanar surfaces, if desired. The term "nonplanar" is used herein to include any spherical or nonspherical surface configuration.

However configured, the combination and the intersection of the surfaces 22, 24 and the surfaces 28, 30 (if provided) of the interior of the lower pelleting volume portion 20 imparts thereto a generally trianguloid shape reminiscent of the working end of a chisel. These surfaces cooperate to define a first corner 34 and a second corner 36 on the interior of the lower pelleting volume portion 20. The corners are connected by a generally linear extent 38 therebetween.

In accordance with the first aspect of the present invention the first corner 34 of the lower pelleting volume portion 20 subtends an acute angle while the second corner 36 subtends an obtuse angle. The acute angle corner 34 lies a greater axial distance from the mouth 14 of the tube 10 than does the obtuse angle corner 36. In the preferred case the acute angle corner 34 has a value of approximately 2Θ degrees, where Θ is the angle of inclination of the cavity C (FIG. 7) in which the tube is to be deployed. Also in the preferred instance the obtuse angle corner 36 has a value of approximately (180−2Θ) degrees. Of course, other suitable values for the acute and obtuse angles may be selected.

Figure 8:
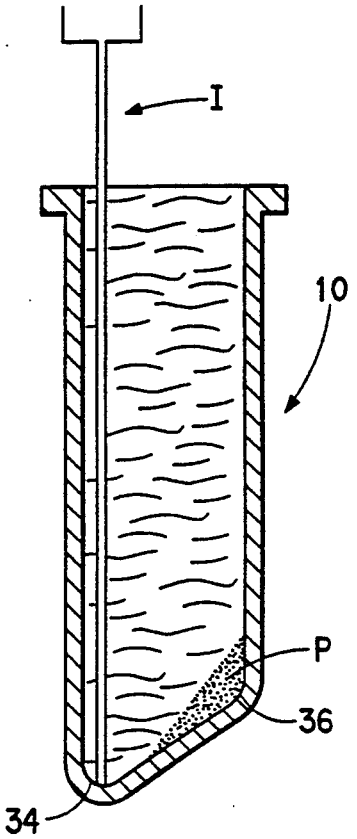
FIGS. 7 and 8 are side elevational views respectively showing the tube of FIGS. 1 through 6 while in use within a centrifuge instrument and after such use with a pellet formed therein.

When in use, the tube 10 in accordance with the first aspect of the present invention should be appropriately inserted within a cavity C of a pelleting centrifuge rotor R such that the obtuse corner 36 is the radially outermost point of the tube 10. Such a disposition is illustrated in FIG. 7. (It is noted that the rotor R is not crosshatched for clarity of illustration.) When so disposed, as the result of exposure to a centrifugal force field a pellet P of clumped solid particles forms in the obtuse angle corner 36. When the tube 10 is removed from the rotor R and held in an upright orientation (as seen in FIG. 8) the supernatant drains to the other, acute angle, corner 34. Thus, an implement, such as a pipette or syringe, may be inserted into this acute angle corner 34 to expeditiously withdraw the supernatant therefrom. It should be appreciated that the pellet P is not disturbed as the implement is used to withdraw the supernatant from the tube 10.

An indicia 40 may be provided on the tube 10 to assist in properly locating the tube 10 within the cavity C of the rotor R so that the obtuse angle corner 30 is positioned as the radially outermost point of the tube. The indicia 36 may take any convenient form, such as a visual or a shape indicia.

Figure 10:
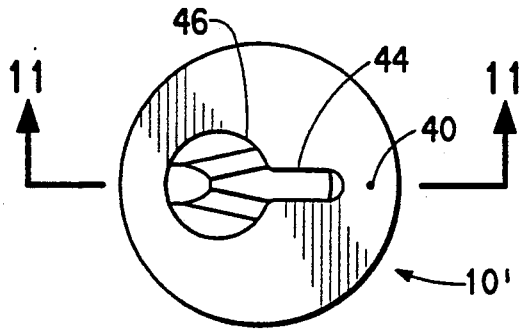
Figure 11:
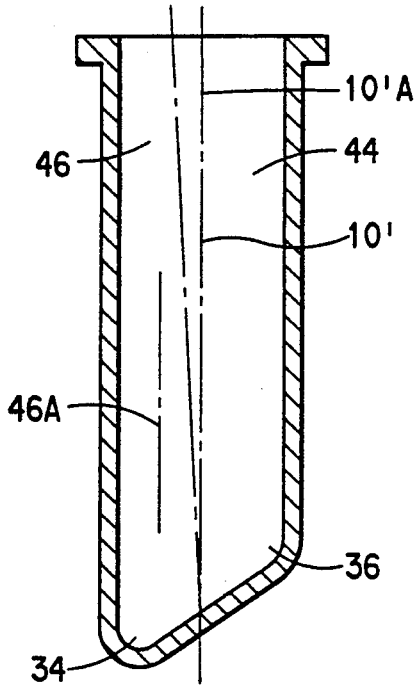
FIG. 11 is a side elevational view entirely in section, taken along section lines 11—11 in FIG. 10.
Figure 9:
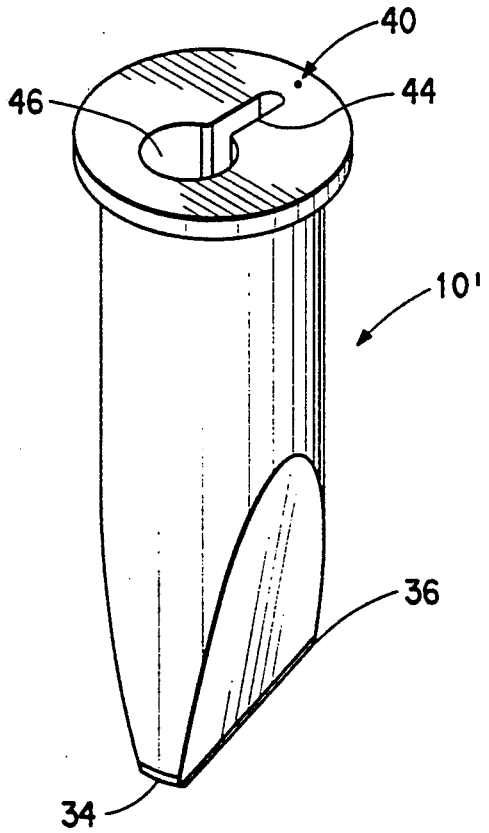

A tube 10′ in accordance with a second aspect of the present invention is illustrated in FIGS. 9 through 11. In accordance with this aspect of the invention the interior volume of the tube 10′, when viewed in a plane transverse to its axis 1O′A (i. e., the plane of FIG. 10), has a keyhole-shaped configuration defined by a generally diametrically extending constricted slot-like region 44 and an adjacent relatively enlarged guide channel region 46. The guide channel region 46 extends laterally along the interior of the tube 10′and communicates with the constricted slot-like region 44 throughout its length. The slot-like region 44 may be configured as other than the generally rectangular shape shown. Similarly, although it is shown as cylindrical, it should also be understood that the guide channel 46 may be rectangularly or otherwise configured, if desired. Depending upon the configuration of the exterior of thf tube 10′ the axis 46A (FIG. 11) of the guide channel 46 may align in parallel relationship with the axis 1O′A or may define an angle therewith. The constricted region 44 of the interior of the tube 10′ is sized such that only the guide channel 46 is sufficiently large to accept the supernatant removal implement (in this usage, typically a pipette). By forming the interior volume of the tube 10′ in a keyhole-shaped configuration a relatively lesser volume of a sample may more completely fill the interior of the tube 10′ and be processed in the rotor R without the necessity of a tube adapter.

A tube 10′ having a keyhole-shaped interior configuration as defined by the constricted region 44 and the guide channel 46 may be used in a tube, as the tube 10 (as illustrated in FIGS. 1 through 8) in which the lower corners 34, 36 are, respectively, acute and obtuse angles. In this instance the guide channel 46 is arranged such that an extension of the axis 46A of the channel 46 projects toward the acute corner 34. Thus, the supernatant removal implement is guided through the channel 46 directly into the acute angle corner 34 in which the supernatant tends to collect. It should be understood, however, that a tube 10′ in accordance with the second aspect of the present invention may be used with a tube in which the corners 34, 36 are each defined by a right angle.

The distinctive keyhole-shaped configuration of the interior volume of the tube 10′ also serves as a convenient indicia to facilitate orientation of the tube 10′ in the rotor R such that, in use, the contricted region 44 lies a greater radial distance from the axis of rotation CL (i. e., radially outboard of) the guide channel 46. If desired, an additional indicia 40 may be provided on the tube 10′ for the same purpose.

Those skilled in the art, having the benefit of the teachings of the present invention as hereinabove set forth may effect numerous modifications thereto. Such modifications as are discussed herein and which appear to those skilled in the art are to be construed as lying within the scope of the present invention, as defined by the appended claims.

What is claimed is:

1. A tube for use in a pelleting centrifuge rotor to separate solid particles from a liquid supernatant in which they are suspended, the tube having a body with an interior volume, the tube terminating in a mouth, the interior volume comprising an upper portion and a lower pelleting portion, the tube having an axis extending therethrough, the pelleting portion being defined by at least first and second interior surfaces which converge toward each other to meet along a line of convergence that forms a tube bottom, the pelleting portion of the tube having a first and a second corner respectively defined at a respective end of the line of convergence, the first corner subtending an acute angle defined between the line of convergence and a portion of the tube interior and the second corner subtending an obtuse angle defined between the line of convergence and another portion of the tube interior.

the corner subtending the acute angle lying a greater axial distance from the mouth of the tube than the corner subtending the obtuse angle.

2. The tube of claim 1 further comprising an indicia on the tube for orienting the tube within a recess of a pelleting centrifuge rotor so that, in use in the rotor the corner subtending the obtuse angle is disposed at the greatest distance from the axis of rotation whereby a pellet forms within that corner.

3. The tube of claim 1 wherein the improvement further comprises:

the interior volume of the tube has a generally keyhole-shaped configuration when viewed in a plane perpendicular to the axis of the tube, the keyhole-shaped configuration being defined by a diametrically extending constricted region and an relatively enlarged, relative to the constricted region, guide channel adjacent thereto, the guide channel having an axis extending therethrough that projects toward the corner subtending the acute angle.

4. The tube of claim 3 wherein only the guide channel has a size sufficient to accept a supernatant removal implement.

5. The tube of claim 3 further comprising an indicia on the tube for orienting the tube within a recess of a pelleting centrifuge rotor so that, in use in the rotor the corner subtending the obtuse angle is disposed at the greatest distance from the axis of rotation whereby a pellet forms within that corner.

6. A tube for use in a pelleting centrifuge rotor to separate solid particles suspended in a liquid supernatant from the supernatant, the tube having a body with an interior volume, the tube terminating in a mouth, the interior volume comprising an upper portion and a lower pelleting portion, the tube having an axis extending therethrough, the pelleting portion being defined by at least a first and a second interior surface which cooperate to form a first and a second corner therein, the improvement comprising:

the interior volume of the tube has a generally keyhole-shaped configuration when viewed in a plane perpendicular to the axis of the tube, the keyhole-shaped configuration being defined by a diametrically extending constricted region and an relatively enlarged, relative to the constricted region, guide channel adjacent thereto, the guide channel having an axis extending therethrough that projects toward a corner of the tube.

7. The tube of claim 5 wherein only the guide channel is sized to accept a supernatant removal implement.

8. The tube of claim 7 further comprising an indicia on the tube for orienting the tube within a recess of a pelleting centrifuge rotor so that, in use in the rotor the constricted region lies a greater radial distance from the axis of rotation than does the guide channel.

* * * * *